United States Patent [19]

Inoue

[11] 3,945,518

[45] Mar. 23, 1976

[54] LIFTING APPARATUS WITH HYDRAULIC OPERATED MEANS TO MOVE A COUNTERWEIGHT THEREON

[75] Inventor: Kazuo Inoue, Tokyo, Japan

[73] Assignee: Kabushiki Kaisha Komatsu Seisakusho, Tokyo, Japan

[22] Filed: Nov. 21, 1973

[21] Appl. No.: 418,024

[30] Foreign Application Priority Data

Nov. 24, 1972 Japan ..... 47-117124

[52] U.S. Cl. ..... 214/142; 212/49; 91/442

[51] Int. Cl.[2] ..... B66C 23/72; B66F 9/00

[58] Field of Search ..... 212/49; 91/442, 268; 214/142

[56] References Cited

UNITED STATES PATENTS

| | | | |
|---|---|---|---|
| 2,474,681 | 6/1949 | Lane | 91/442 X |
| 2,811,136 | 10/1957 | Westcott et al. | 91/442 X |
| 3,236,391 | 2/1966 | Kennedy | 212/49 X |
| 3,265,218 | 8/1966 | Stefanutti | 212/49 X |

FOREIGN PATENTS OR APPLICATIONS

| | | | |
|---|---|---|---|
| 216,381 | 9/1957 | Australia | 214/142 |

*Primary Examiner*—Robert J. Spar
*Assistant Examiner*—Johnson: R. B.
*Attorney, Agent, or Firm*—Armstrong, Nikaido & Wegner

[57] ABSTRACT

A hydraulic circuit for moving a heavy article or counterweight is provided which includes a cylinder, a source of hydraulic pressure for supplying oil to the cylinder, and a bypass valve provided in a conduit for connecting the source to the cylinder. The bypass valve drains part of the oil supplied to the conduit when the pressure in the conduit drops below a predetermined value so as to smoothly move the heavy weight from first position to second position without shock.

4 Claims, 5 Drawing Figures

LIFTING APPARATUS WITH HYDRAULIC OPERATED MEANS TO MOVE A COUNTERWEIGHT THEREON

BACKGROUND OF THE INVENTION

1. Field of the Invention

This invention relates to a hydraulic circuit including a cylinder for moving a heavy article or counterweight from one position to another position, and more particularly a hydraulic circuit adapted for smoothly moving a heavy article without shock.

2. Description of the Prior Art

Referring to FIGS. 1 and 2, which show the conventional pipe layer bulldozer, the bulldozer has a crane *b* at one side of the body *a* thereof and a counterweight *c* provided through a quadric link *d* at the other side of the body a. A cylinder (e) is provided for moving the counterweight *c* between the first position as shown in FIG. 1 extending from the body *a* and the second position as shown in FIG. 2 drawn to the body *a*. This pipe layer bulldozer has a disadvantage that since a large force is necessary at the initial part of the movement of the counterweight *c* by the cylinder *e* from the first to the second positions and a small force is sufficient at the end of the movement thereof, if the cylinder *e* is quickly moved in order to accelerate the moving speed of the counterweight *c*, the counterweight *c* stops with shock at the end of its stroke with the result that the shock stress takes place at the pivotal portions of the quadric link *d* and cylinder *e* causing the pivotal portions to be damaged.

SUMMARY OF THE INVENTION

It is, therefore, an object of the present invention to provide a hydraulic circuit including a cylinder for moving a heavy article which eliminates the aforementioned disadvantages of the conventional pipe layer bulldozer and generates large force at the cylinder at the initial part of the movement of the heavy article to quickly move the cylinder while the heavy article is moving and decelerates the cylinder smoothly at the end of the movement of the heavy article.

BRIEF DESCRIPTION OF THE DRAWINGS

This and other objects, features and advantages of the hydraulic circuit according to the present invention will become more fully apparent from the following description taken in conjunction with the accompanying drawings, in which like reference numerals and characters designate corresponding parts and components and in which.

DESCRIPTION OF THE PREFERRED EMBODIMENT

Figure 1:
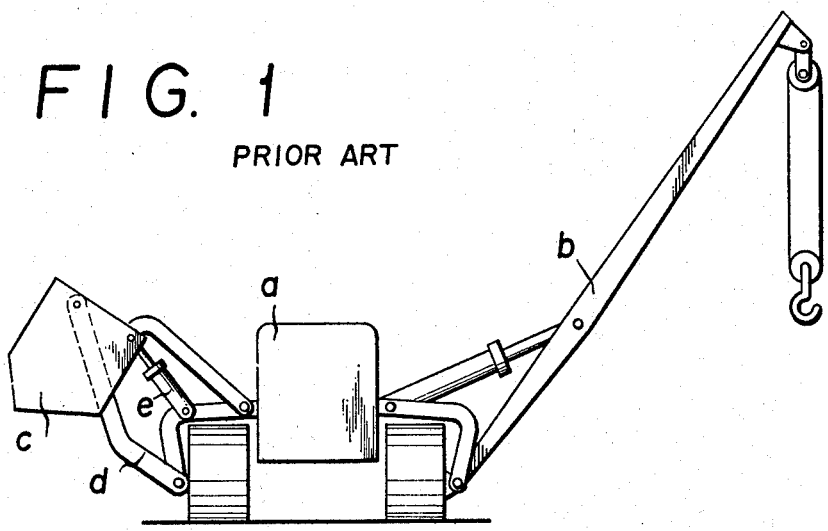
FIG. 1 PRIOR ART
FIGS. 1 and 2 are front views of the conventional pipe layer bulldozer.
Figure 2:
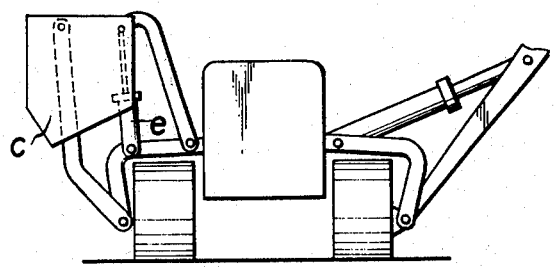
FIG. 2 PRIOR ART
Figure 3:
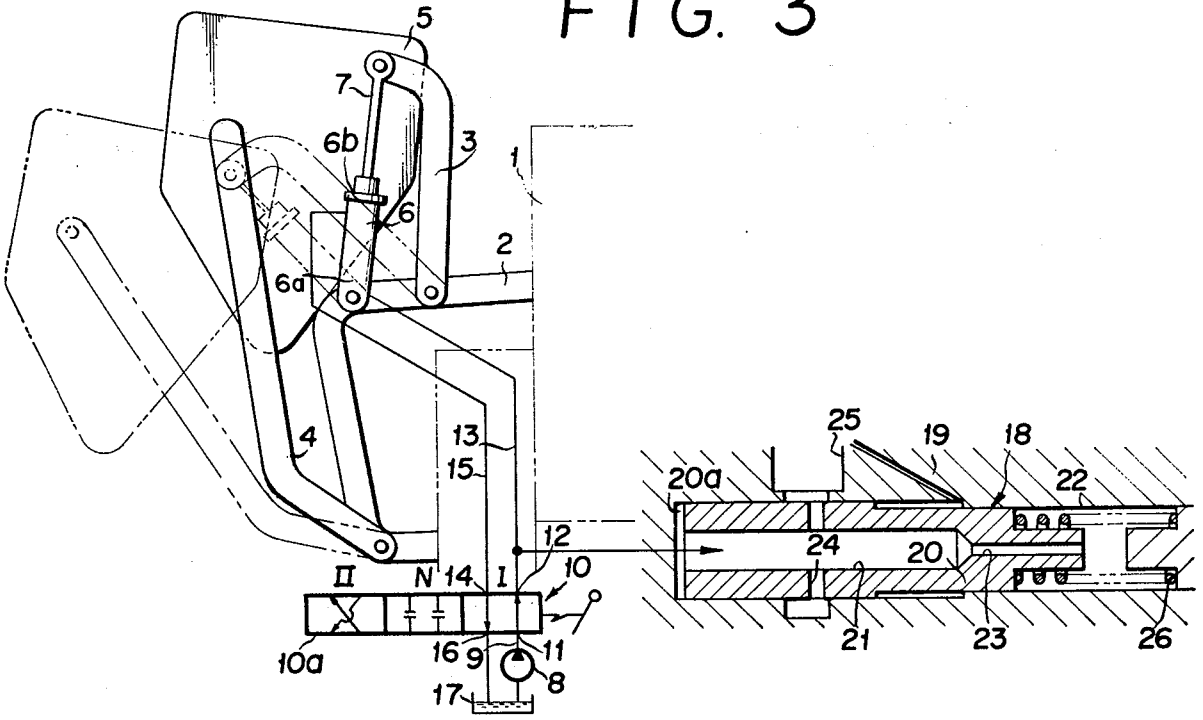
FIG. 3 is an explanatory view of one embodiment of the hydraulic circuit with a counterweight of the present invention.

In FIG. 3, a counterweight 5 is pivotally connected through a pair of links 3 and 4 to a frame 2 which projects from one side of the body 1 of a bulldozer, and a cylinder 6 is also pivotally connected to both the counterweight 5 and frame 2. A piston rod 7 is reciprocatingly engaged with the cylinder 6 through a piston (not shown) connected thereto. When the piston rod 7 with the piston (not shown) is reciprocatingly moved in the cylinder 6, the counterweight 5 is moved between a first position extending from the body 1 of the bulldozer and a second position drawn to the body 1.

The hydraulic circuit of the present invention comprises an oil reservoir 17, a pump 8 connected at input thereof to the oil reservoir 17, and a control valve 10. The control valve 10 has a first port 11 connected to the output of the pump 8, a second port 12 connected through a conduit 13 with the bottom chamber **6*a* of the cylinder 6, a third port 14 connected through a conduit 15 with the rod chamber 6*b* of the cylinder 6, and a fourth port 16 connected to the oil reservoir 17. The hydraulic circuit also includes a by-pass valve 18 connected to the conduit 13 for draining the conduit 13 when the hydraulic pressure in the conduit 13 is lowered than a predetermined value. The control valve 10 has a spool 10*a* having three positions I, N and II, and when the spool 10*a* of the control valve 10 is at position I, the first port 11 of the valve 10 is communicated with the second port 12. When the spool 10*a* is at position N, name of the ports of the control valve 10 are connected with each other, and when the spool 10*a* is at position II, the first port 11 is connected with the third port 14 and the second port 12 is connected with the fourth port 16**.

The by-pass valve 18 formed in a valve box 19 which has a drain port 25 formed therein and a spool 20 slidably inserted thereinto. The spool 20 of the by-pass valve 18 has a first axial hole 21 of large diameter connected with the conduit 13 and a second axial hole 23 of small diameter connected to the first hole 21 at one side and also connected with a back pressure chamber 22 formed at the other side of the by-pass valve 18. The first hole 21 of the spool 20 is connected to drain port 25 through a radial drain hole 24 formed in the spool 20. The spool 20 of the by-pass valve 18 is urged by a coil spring 26 disposed between the spool 20 and the right end of the by-pass valve 18 for draining the conduit 13 connected to the first hole 21.

Figure 4:
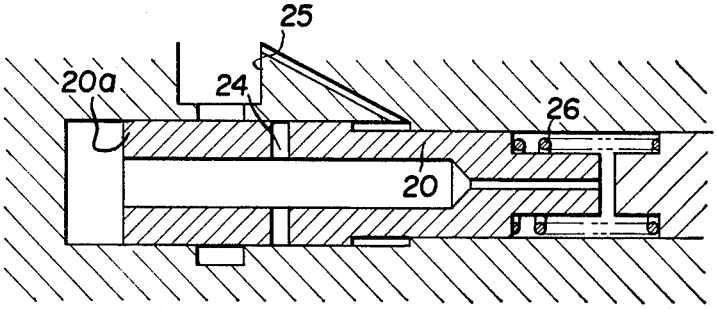
FIG. 4 is a schematic view of a by-pass valve used in the hydraulic circuit for explaining the operation thereof.
Figure 5:
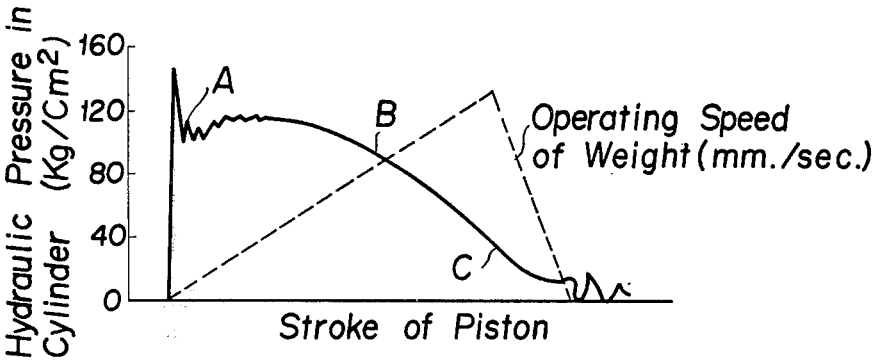
FIG. 5 is a graph showing the relationships of the pressure in the cylinder and piston speed in terms of the stroke of the piston for explaining the operation of the hydraulic circuit of the invention.

In operation of the hydraulic circuit thus constructed when the counterweight 5 is moved from the first position extended from the body 1 of the bulldozer to the second position drawn to the body 1, if the spool **10*a* of the control valve 10 is moved to the position I, the hydraulic fluid through the pump 8 from the oil reservoir 17 is supplied through the first port 11 of the control valve 10 connected to the output of the pump 8, the second port 12 connected through the spool 10*a* of the control valve 10 with the first port 11, the conduit 13 connected to the second port 12 of the control valve 10 to the bottom chamber 6*a* of the cylinder 6. At this time, the spool 20 of the by-pass valve 18 is so disposed as to drain the first drain hole 21 communicated with the conduit 13 through the radial hole 24 formed in the spool 20 of the by-pass valve 18 and the drain port 25 of the by-pass valve 18, but since the hydraulic pressure in the conduit 13 from the pump 8 through the control valve 10 urges the end surface 20***a* of the spool 20 of the by-pass valve 18 against the tension of the spring 26, the spool 20 of the by-pass valve 18 moves to the position as designated in FIG. 4 so as to shut off the connection of the drain hole 21 of the spool 20 of the by-pass valve 18 with the drain port 25 through the radial drain hole 24. This results in all the hydraulic fluid from the pump 8 through the control valve 10 and the conduit 13 flowing into the bottom chamber 6*a* of the cylinder 6, and accordingly the pressure in the bottom chamber 6*a* of the cylinder 6 is abruptly increased to the level as illustrated by A in the graph in FIG. 5 so as to rotatably move the counterweight 5 upwardly in FIG. 3 toward the second position. As the counterweight 5 is moved from the first position to the second position, the hydraulic pressure in the bottom chamber 6*a* of the cylinder 6 is decreased as designated by B in FIG. 5, and as the pressure in the bottom chamber 6*a* of the cylinder 6 is reduced, the operating speed of the piston is increased. When the pressure in the bottom chamber 6*a* of the cylinder 6 is decreased to a predetermined pressure as represented by C in FIG. 5, the hydraulic pressure on the end surface 20*a* of the spool 20 of the by-pass valve 18 is accordingly decreased so that the spool 20 is urged backward or to the left by the spring 22 disposed at the right end of the bypass valve 18. This movement connects drain port through the drain hole 24 with the conduit 13 with the result that part of the hydraulic fluid in the conduit 13 is drained through the drain port 25, and accordingly the hydraulic oil supplied from the pump 8 through the control valve 10 and the conduit 13 to the bottom chamber 6*a* of the cylinder 6 is decreased. This results in the operating speed of the piston rod 7 with the piston slidably inserted into the cylinder 6 being abruptly decelerated with the result that the counterweight 5 is smoothly stopped at the second position.

Since the hydraulic circuit of the present invention is thus constructed, when the output of the pump 8 is constant and the counterweight or heavy article 5 is moved from the first position extending from the body 1 of the bulldozer to a second position drawn to the body 1 thereof, the hydraulic pressure in the bottom chamber 6*a* of the cylinder 6 is abruptly increased and is gradually decreased while the counterweight 5 is moving and the operating speed of the piston rod 7 with the piston (not shown) slidably inserted into the cylinder 6 is gradually accelerated. Further when the hydraulic pressure in the bottom chamber 6*a* of the cylinder 6 is decreased to a predetermined value in the vicinity of the second position of the counter-weight 5, the by-pass valve 18 is actuated so that part of the hydraulic oil supplied into the bottom chamber 6*a* of the cylinder 6 from the pump 8 is drained through the bypass valve 18 to abruptly decrease the operating speed of the piston rod 7 with the piston (not shown) slidably inserted into the cylinder 6.

Therefore, the hydraulic pressure in the bottom chamber 6*a* of the cylinder 6 is abruptly increased at the initial part of the movement of the counterweight 5, the cylinder 6 is quickly moved while the counterweight 5 is moving, and the operating speed of the cylinder 6 is abruptly decelerated at the end part of the movement of the counterweight 5, and accordingly the heavy weight or counterweight 5 may be quickly moved from the first to second positions in a manner that the heavy article 5 is smoothly moved to a desired position without shock stress at the respective parts thereby lengthening the life of the respective parts of the bulldozer.

What is claimed is:

1. A lifting apparatus including a counterweight and a hydraulic circuit for moving said counterweight from a first position to a second position, said circuit comprising:

a. a hydraulic cylinder for moving said counterweight from the first position to the second position;

b. source means for supplying hydraulic fluid under pressure to said cylinder;

c. conduit means connected between said hydraulic cylinder and source means for coupling said source means to said hydraulic cylinder; and d. bypass valve means connected to said conduit means and responsive to the pressures therein, for draining a portion of the fluid in said conduit when the hydraulic pressure in said conduit means falls below a predetermined value when the counterweight is in the vicinity of said second position, said bypass valve means comprising a body having a hole therein, a drain port therein coupled to said source means and a spool positioned in said hole in said body, said spool having an axial hole in the center thereof and a radial hole extending from said axial hole to the exterior thereof, wherein when the pressure is below said predetermined value, said spool means moves within the hole in said body, such that said radial hole is aligned with said drain port, such that fluid flows from said conduit through said axial hole, through said radial hole and then through said drain port to said source, whereby the pressure in said hydraulic cylinder is reduced, thereby reducing the speed of movement of said heavy article.

2. The hydraulic circuit of claim 1 wherein said bypass valve means drains said fluid in said conduit as said heavy article approaches said second position.

3. The hydraulic circuit of claim 1 wherein said source means comprises a source of hydraulic fluid and a pump for pumping the hydraulic fluid from said source to said hydraulic cylinder through said conduit.

4. The hydraulic circuit of claim 1 wherein said bypass valve further includes spring means in the hole in said valve body positioned in a chamber between said valve body and said spool and wherein said axial hole extends into said chamber wherein when said pressure is below said predetermined value the pressure of said fluid on the surface of said spool in said chamber and the pressure of said spring is greater than the pressure on the opposing surfaces of said spool whereby said spool is moved to a position where said radial hole is aligned with said drain port.

* * * * *